US007872607B2

(12) United States Patent
Mohammadian et al.

(10) Patent No.: US 7,872,607 B2
(45) Date of Patent: Jan. 18, 2011

(54) DIVERSE SPECTRUM ANTENNA FOR HANDSETS AND OTHER DEVICES

(75) Inventors: Alireza Hormoz Mohammadian, San Diego, CA (US); Samir S. Soliman, San Diego, CA (US)

(73) Assignee: QUALCOMM, Incorporated, San Diego, CA (US)

( * ) Notice: Subject to any disclaimer, the term of this patent is extended or adjusted under 35 U.S.C. 154(b) by 957 days.

(21) Appl. No.: 11/413,369

(22) Filed: Apr. 28, 2006

(65) Prior Publication Data

US 2007/0176834 A1 Aug. 2, 2007

Related U.S. Application Data

(60) Provisional application No. 60/762,770, filed on Jan. 27, 2006.

(51) Int. Cl.
*H01Q 1/24* (2006.01)
*H01Q 13/10* (2006.01)

(52) U.S. Cl. ..... 343/702; 343/767; 343/846

(58) Field of Classification Search ..... 343/700 MS, 343/702, 846, 767, 770
See application file for complete search history.

(56) References Cited

U.S. PATENT DOCUMENTS

| | | | | |
|---|---|---|---|---|
| 6,111,544 | A | 8/2000 | Dakeya et al. | |
| 6,822,611 | B1 * | 11/2004 | Kontogeorgakis et al. | 343/702 |
| 6,882,324 | B1 * | 4/2005 | Chen | 343/790 |
| 6,957,080 | B2 * | 10/2005 | Guetre et al. | 455/552.1 |
| 7,061,434 | B2 * | 6/2006 | Aoyama et al. | 343/702 |
| 7,176,838 | B1 * | 2/2007 | Kinezos | 343/700 MS |
| 2003/0058176 | A1 | 3/2003 | Keilen et al. | |
| 2003/0222827 | A1 | 12/2003 | Sung | |
| 2004/0108967 | A1 | 6/2004 | Fujimura et al. | |
| 2007/0069959 | A1 * | 3/2007 | Wu | 343/700 MS |

FOREIGN PATENT DOCUMENTS

| | | |
|---|---|---|
| EP | 1414108 | 4/2004 |
| EP | 1585193 | 10/2005 |
| JP | 05304413 | 11/1993 |
| JP | 200276736 | 3/2002 |
| JP | 2002290142 A | 10/2002 |
| JP | 2002374122 A | 12/2002 |
| JP | 2003332818 A | 11/2003 |
| WO | 2006000631 | 1/2006 |

OTHER PUBLICATIONS

"A CPW-FED U Type Monopole Antenna For UWB Applications" Antennas and Propagation Society International Symposium, 2005 IEEE vol. 2A, Jul. 3-8, 2005 pp. 512-515 vol. 2A Full Texts.

(Continued)

*Primary Examiner*—Hoang V Nguyen
(74) *Attorney, Agent, or Firm*—Jae Hee Choi; Ramin Mobarhan

(57) ABSTRACT

A system, apparatus and method for a diverse spectrum antenna is disclosed. The diverse spectrum antenna may comprise a circuit board having a ground plane and a chip antenna including a notch, wherein the chip antenna is mounted on the circuit board at a selected distance from the ground plane.

27 Claims, 6 Drawing Sheets

OTHER PUBLICATIONS

"A Planner Elliptical Monopole Antenna For UWB Applications" Wireless Communications and Applied Computational Electromagnetics, 2005. IEEE/ACES International Conference on Apr. 3-7, 2005 pp. 182-182 Full Texts.

"Cable-Current Effects of Miniature UWB Antennas" Antennas and Propagation Society International Symposium, 2005 IEEE vol. 3A, Jul. 3-8, 2005 pp. 524-527 vol. 3A.

International Search Report—PCT/US2007/061246, International Search Authority—European Patent Office—Apr. 27, 2007.

"State of the Art in Ultr-Wideband Antennas" Electrical and Electronics Engineering, 2005 2nd International Conference on Sep. 7-9, 2005 pp. 101-105.

Taiwanese Search Report-096103046, TIPO-Sep. 16, 2009.

Written Opinion-PCT/US2007/061246, International Search Authority—European Patent Office—Apr. 27, 2007.

* cited by examiner

DIVERSE SPECTRUM ANTENNA FOR HANDSETS AND OTHER DEVICES

CLAIM OF PRIORITY UNDER 35 U.S.C. §119

The present Application for Patent claims priority to Provisional Application No. 60/762,770 entitled "An Internal Ultra Wideband Antenna for Handsets and Other Devices" filed Jan. 27, 2006, and assigned to the assignee hereof and hereby expressly incorporated by reference herein.

BACKGROUND

1. Field

The subject technology relates generally to communications systems and methods, and more particularly to systems and methods that enhance device performance by employing an internal chip antenna.

2. Background

Wireless handsets have become much smaller in the last decade while more services have been added such as, for example, Global Positioning Systems (GPS) and Bluetooth technologies. A new technology that is related includes ultra-wideband (UWB) services that provide a new communications system. UWB systems typically employ very low power (e.g., −41.3 dBm/MHz) for short distances and use a bandwidth of at least 500 MHz in the unlicensed portion of the Electro Magnetic spectrum from about 3.1 GHz to about 10.6 GHz. Data rates for UWB systems could be as high as 500 mega bits per second, for example.

UWB systems have a potential to support a spatial capacity (bit/sec/square meter) 1,000 times greater than current 802.11b standards and to support many more users—at much higher speeds and lower costs—than current wireless Local Area Network (LAN) systems. Many of these LANs which were based on 802.11b, have maximum data rates of 11M bit/sec, and drop to about 1M bit/sec at a distance of about 300 feet. Some ultra-wideband developers have claimed peak speeds, with current silicon, of 50M bit/sec or more over 30 feet. The actual distance and data rate generally depend on a range of variables, including signal power and antenna design.

As with other communications systems, antennas are used for transmitting and receiving UWB signals. Design and development of antennas for UWB systems is generally challenging due to the wide bandwidth of the signal. Presently, many devices employ internal antennas for their voice only communications due to the demand by the consumer for smaller, sleeker handsets. Generally, even those manufacturers or service providers who allow external antennas on their handsets, provide such antennas for basic voice services. Designs for UWB antennas have yet to be integrated effectively inside the handset. For example, from a cost point of view, an internal UWB antenna generally needs to be inexpensive so that it does not add significantly to the price of the handset. Also, due to the space limitations of current handsets, a large portion of real estate should not be taken to support UWB functionality.

SUMMARY

The techniques disclosed herein address the above stated needs by providing a diverse spectrum antenna that operates over multiple frequency range including UWB. In one aspect, a diverse spectrum antenna comprises a circuit board having a ground plane; and a chip antenna including a notch, wherein the chip antenna is mounted on the circuit board at a selected distance from the ground plane.

In another aspect, a method for producing a diverse spectrum antenna comprises applying a metallic portion to a dielectric substrate to generate a chip antenna; and notching the metallic portion of the chip antenna. The ground plane may be coupled at a selected distance from the chip antenna. The chip antenna may be shaped as a rectangular shape with an elliptical component. The ground plane may be coupled at a selected distance from the chip antenna, wherein the ground plane has an elliptical component corresponding to and opposing the elliptical component of the chip antenna.

In a further aspect, an antenna may be produced by a process as in the method described above.

In yet another aspect, an apparatus for use in communication comprises a communication module configured to support communication functions; and an antenna module configured to transmit and receive communication signals, wherein the antenna module comprises: a chip antenna having a notch; and a ground plane operatively coupled to the chip antenna.

In still a further aspect, a method for implementing a diverse spectrum antenna comprises implementing a ground plane on a circuit board; and mounting a chip antenna on the circuit board at a selected distance from the ground plane, wherein the chip antenna includes a notch.

In the above embodiments, the chip antenna may be a rectangular shape with an elliptical component. The ground plane may have an elliptical component corresponding to and opposing the elliptical component of the chip antenna. The notch may be a rectangular shape. The notch may be located at an upper edge of the chip antenna. The chip antenna may comprise a metal portion attached to a dielectric substrate.

BRIEF DESCRIPTION OF THE DRAWINGS

Various embodiments will be described in detail with reference to the following drawings in which like reference numerals refer to like elements, wherein.

DETAILED DESCRIPTION

Generally, embodiments provide an antenna that operates across multiple frequency range. This may include applying a metallic portion to a dielectric substrate to form an antenna and notching the metallic portion of the antenna to increase the electrical dimension or property of the antenna. The antenna can be employed for communications in an ultra-wideband wireless device. Other aspects include shaping at least one edge of the metallic portion of the antenna to facilitate an impedance parameter for the antenna and/or shaping a ground portion of the antenna to accommodate a ground plane having a similar shape as the antenna. Various processes are provided for optimizing the antenna across a plurality of frequency spectrums.

In the following description, specific details are given to provide a thorough understanding of the embodiments. However, it will be understood by one of ordinary skill in the art that the embodiments may be practiced without these specific detail. For example, circuits may be shown in block diagrams in order not to obscure the embodiments in unnecessary detail. In other instances, well-known circuits, structures and techniques may be shown in detail in order not to obscure the embodiments.

Also, it is noted that the embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

Moreover, as disclosed herein, a "storage medium" may represent one or more devices for storing data, including read only memory (ROM), random access memory (RAM), magnetic disk storage mediums, optical storage mediums, flash memory devices and/or other machine readable mediums for storing information. The term "machine readable medium" includes, but is not limited to portable or fixed storage devices, optical storage devices, wireless channels and various other mediums capable of storing, containing or carrying instruction(s) and/or data.

Figure 1:
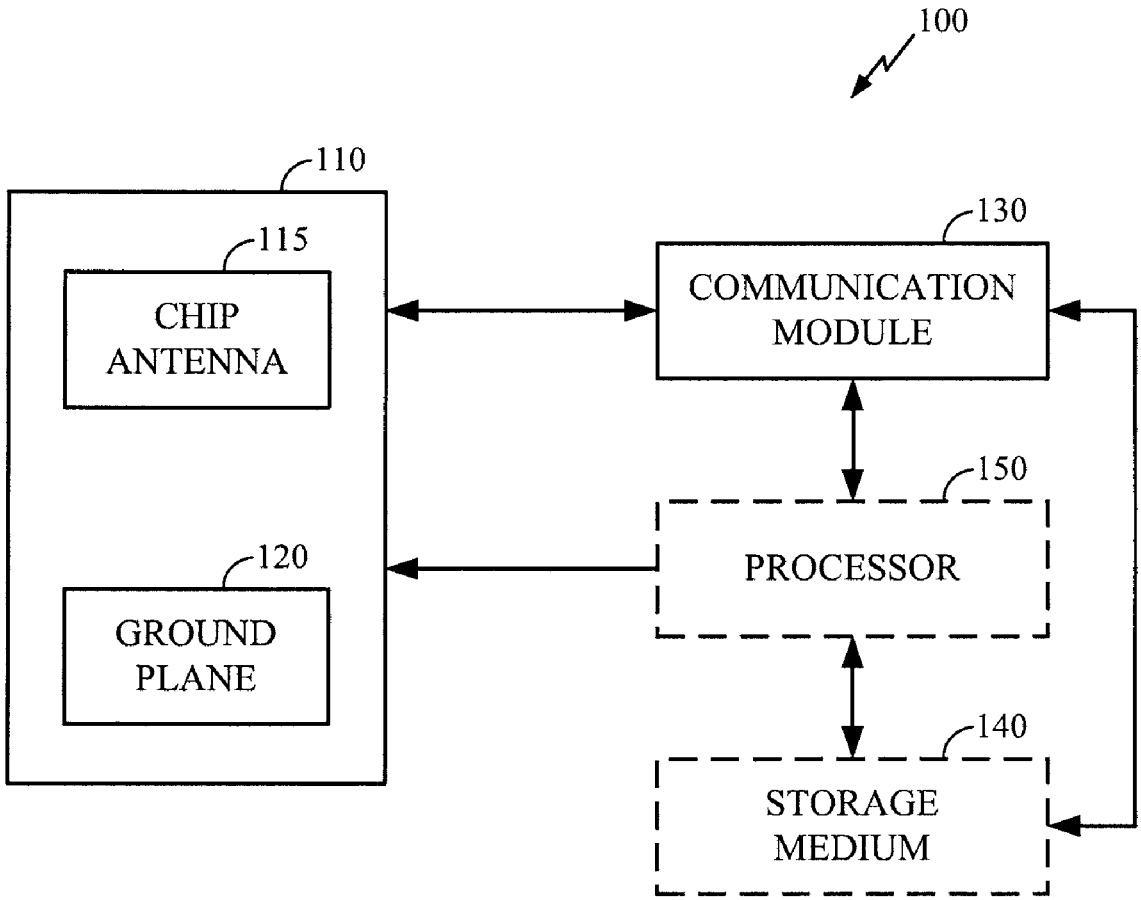
FIG. 1 illustrates an example device with an antenna operable in multiple frequency band.

FIG. 1 illustrates a device 100 implementing an antenna that operates across multiple frequency spectrums. For example, device 100 may be employed in a wireless network where UWB and other frequency signals are transmitted and received such as between two devices supporting UWB communications or between a device and a base station (not shown). Device 100 comprises an antenna module 110 to receive and/or transmit communication signals and a communication module 130 to support communication functions for processing the communication signals transmitted and/or received by antenna module 110. Communication module 130 may support various communication protocols. For example, communication module 130 may support communication based on one or more communication technologies such as UWB, Bluetooth, TDMA, FDMA, CDMA, or a combination thereof.

Device 100 may be a non-wireless device or a wireless device, and can be hand-held, portable as in vehicle mounted (including cars, trucks, boats, trains, and planes) or fixed, as desired. Examples of device 100 may include, but is not limited to, a mobile phone, a personal data assistant, a gaming device, a laptop computer, a desktop computer, and other fixed or mobile devices. Also, it should be noted that device 100 is a simplified example for purposes of explanation. Accordingly, device 100 may comprise additional elements such as, for example, a storage medium 140 and a processor 150. Storage medium 140 may store various data such as, but not limited to, communication protocols, data for transmission and/or data received. Processor 150 may be configured to control some or all operations of device 100. Other elements (not shown) may also be included such as a user interface, an audio output, a video output and/or a camera. Moreover, it should be noted that one or more elements of device 100 may be combined and/or rearranged without affecting the operations of device 100.

Antenna module 110 comprises a chip antenna 115 operatively coupled to a ground plane 120 to transmit and/or receive signals over a plurality of frequencies across at least two spectrums (e.g., ultra-wideband and Bluetooth). The operation characteristics of antenna module 110 for the plurality of frequencies may be designed based on various aspects of chip antenna 115 and/or ground plane 120. One example aspect is a notch that may be implemented in chip antenna 115, wherein the shape and/or location of the notch affects the operation characteristics of antenna module 110. Other aspects include various shape dimensions and/or distances between chip antenna 115 and ground plane 120. The different aspects will be described more in detail below with respect to FIGS. 2-4.

Generally, chip antenna 115 and ground plane 120 are internally implemented according to different processes to facilitate device performance in one or more communication systems. Functional capabilities for chip antenna 115 are provided for performance that mitigates real estate and cost requirements of conventional systems by generating the appropriate antenna parameters for antenna module 110 that covers multiple frequency spectrums. For example, antenna module 110 may be provided to meet both Bluetooth capabilities and UWB system bandwidth requirements. By satisfying a plurality of spectrum requirements, cost and real estate can be reduced since additional antennas generally do not need to be added to device 100 to meet various spectrum performance requirements. For purposes of explanation, antenna module 110 arrangement will be described for operation in UWB frequencies. However, it would be apparent to one of skilled in the art that the teachings discussed below are applicable to other frequencies.

Figure 2:
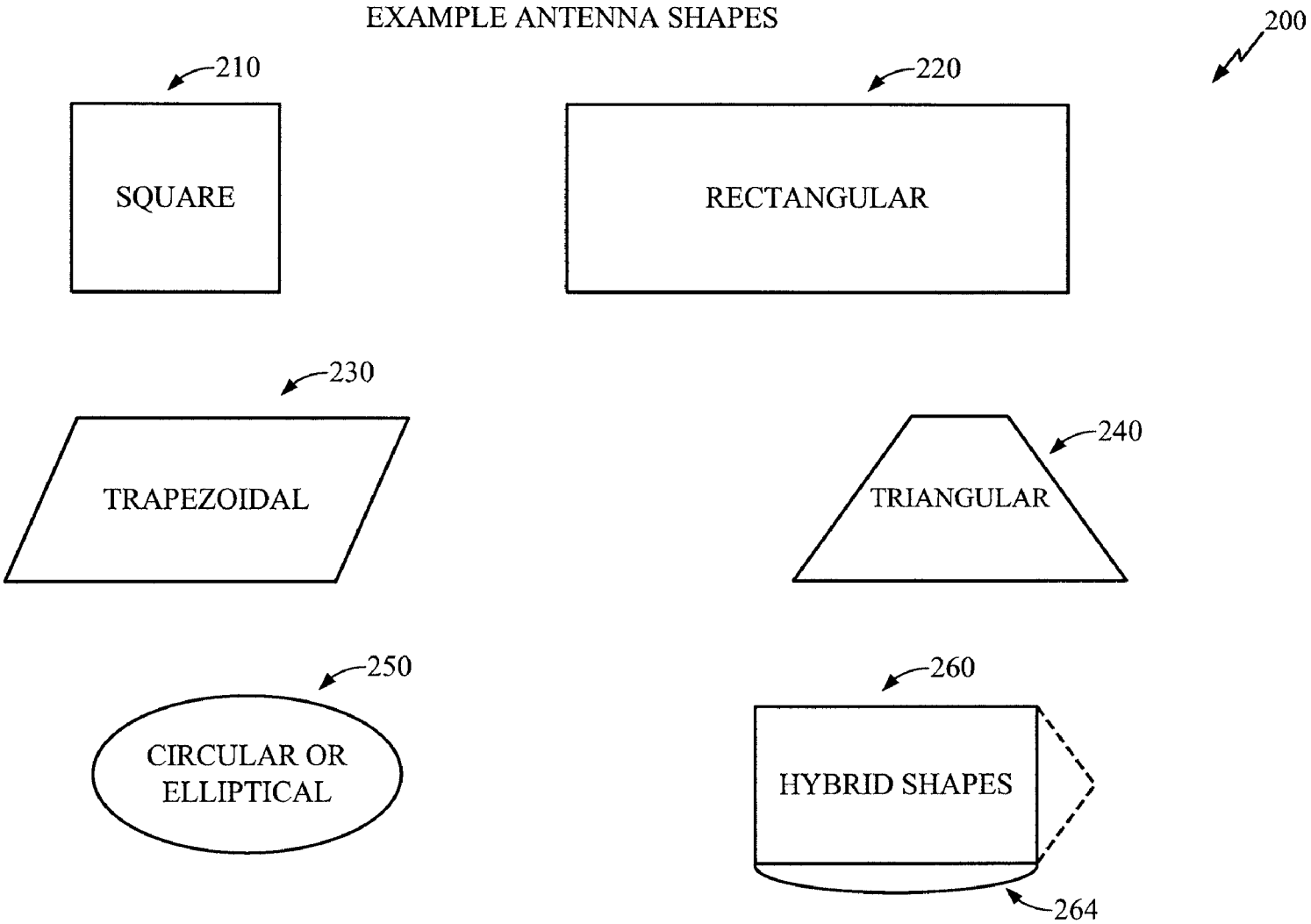
FIG. 2 illustrates example shapes for a chip antenna.

In some embodiments, chip antenna 115 that operates in UWB frequencies may be rectangular in shape having a contoured lower edge for monopole functionality. However, other shapes can be used. FIG. 2 illustrates some example shapes 200 for use as an ultra-wideband chip antenna. Shapes 200 represent the exterior shapes that can be used for a chip antenna. A square shape 210 may be employed, where four sides of the antenna are substantially the same size. It is to be appreciated that other multi-sided chip antennas are also possible such as a polygonal shape. Another example shape is a rectangular shape 220. Here, the chip antenna may be longer on the horizontal plane than the vertical but the opposite design is possible where the antenna orientation is longer in the vertical rather than the horizontal plane. Trapezoidal shapes 230 are also possible for the antenna where one or more sides of the antenna may have an angular component applied to the side. Similarly, triangular shapes 240 are possible where one side of the antenna may be smaller or substantially smaller that an opposite side of the antenna. Even circular or elliptical shapes 260 are possible for the chip antenna. This can include having a substantially consistent diameter for more of a circular shape or a varying radius depending on the angle from the center of the chip and/or desired mounting orientation. Finally, hybrid shapes 260 are also possible. For example, this could include a rectangular or square shape having an elliptical or radial component 264. As can be appreciated, a plurality of different or similar shapes can be combined to form various hybrid shapes 260.

Figure 3:
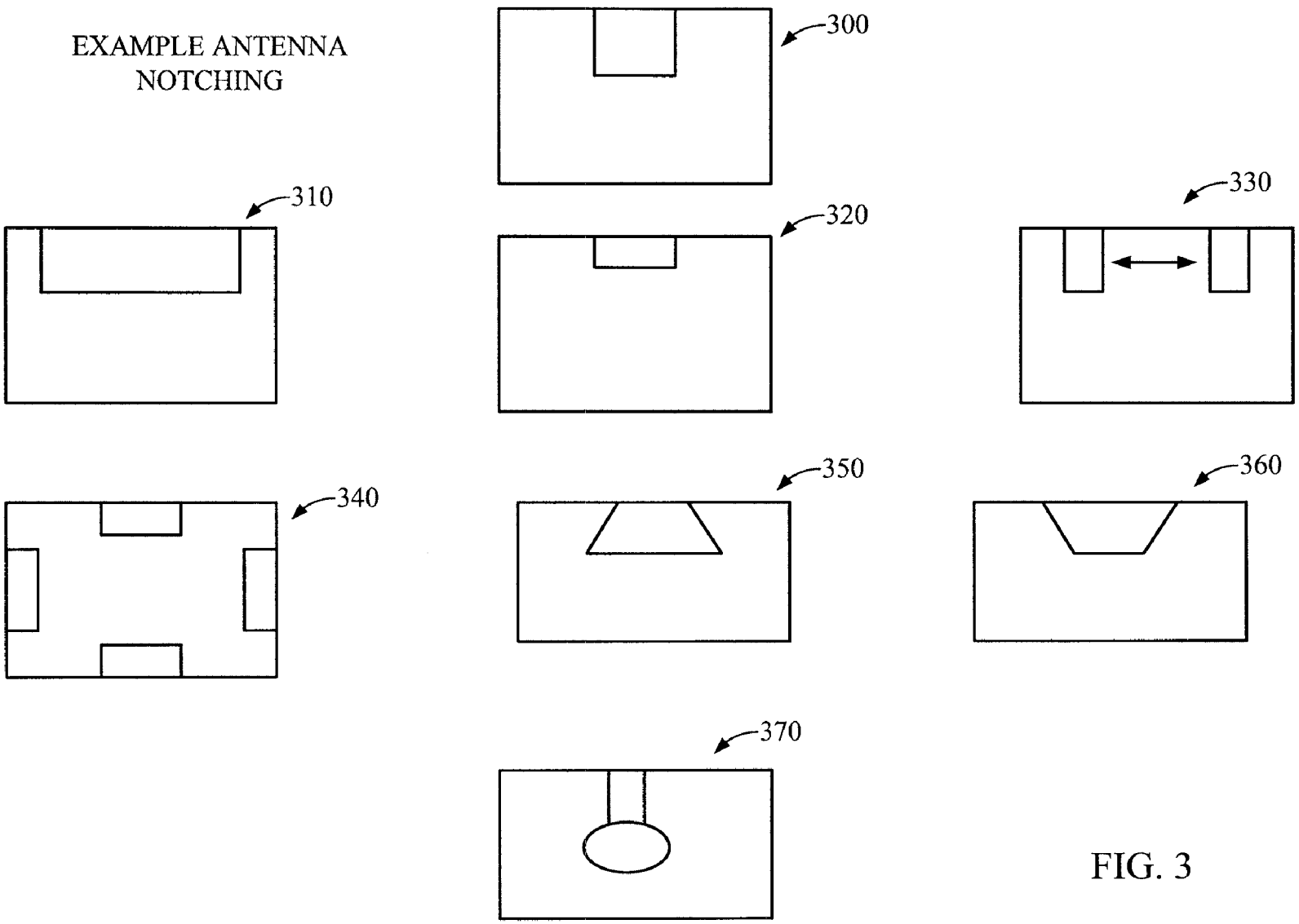
FIG. 3 illustrates example shapes and portions for notches that may be applied to chip antennas.

A notch or other pattern can be provided in an edge, such as an upper edge for example, of chip antenna 115. The notch may introduce an additional degree of freedom for improving the return loss across the bandwidth of interest. FIG. 3 illustrates example shapes and portions for notches that may be applied to ultra-wideband chip antennas. For purposes of explanation, the notching will be described with reference to a rectangular chip antenna. However, it would be apparent to one of skilled in the art that the notching is applicable to chip antennas having shapes other than a rectangular shape.

A rectangular-antenna 300 is shown having generally a square notch portion at the top of the chip antenna. The notch may be elongated horizontally as shown in antennas 310 and 320. It is to be appreciated that the notch could be decreased in the horizontal dimension and/or extended vertically such as antenna 330. The notch can also be positioned at different orientations and/or different location on the antenna. This may also include employing more than one notch to achieve desired antenna effects. Antenna 340 illustrates various notch positions, where one or more notches may be placed at different locations on the chip antenna. Alternative types of notches are shown in antennas 350 and 360 in which the notches have more of a keystone shape. However, various other types of notch shapes may be employed such as the hybrid notch shape of both elliptical and rectangular component as illustrated by antenna 370.

Chip antenna 115 may include a metallic portion attached to a dielectric substrate. For example, chip antenna 115 can be manufactured with a metal sheet and attached to a dielectric slab having a high dielectric constant (e.g., about 10 or higher). A higher dielectric constant promotes having the respective monopole appear electrically "longer." The dielectric can be a thicker microwave substance. For example, the monopole for the respective chip antenna 115 could be copper that was placed on a substrate (or etched from a solid metal). Another option is to produce the dielectric through injection molding and then metallize its surface with a desired pattern for chip antenna 115 such as via a vapor deposition process, for example. In yet another example, the monopole on chip antenna 115 may be etched on a circuit board that operates as ground plane 120 for the respective monopole.

Portions of device 100 such as a printed circuit board can be employed for ground plane 120 to further conserve real estate and mitigate cost. Additionally, chip antenna 115 and ground plane 120 can have patterns with respect to a surface of the plane or the device that promotes substantially consistent or uniform impedance for chip antenna 115 across diverse frequency spectrums.

Figure 4:
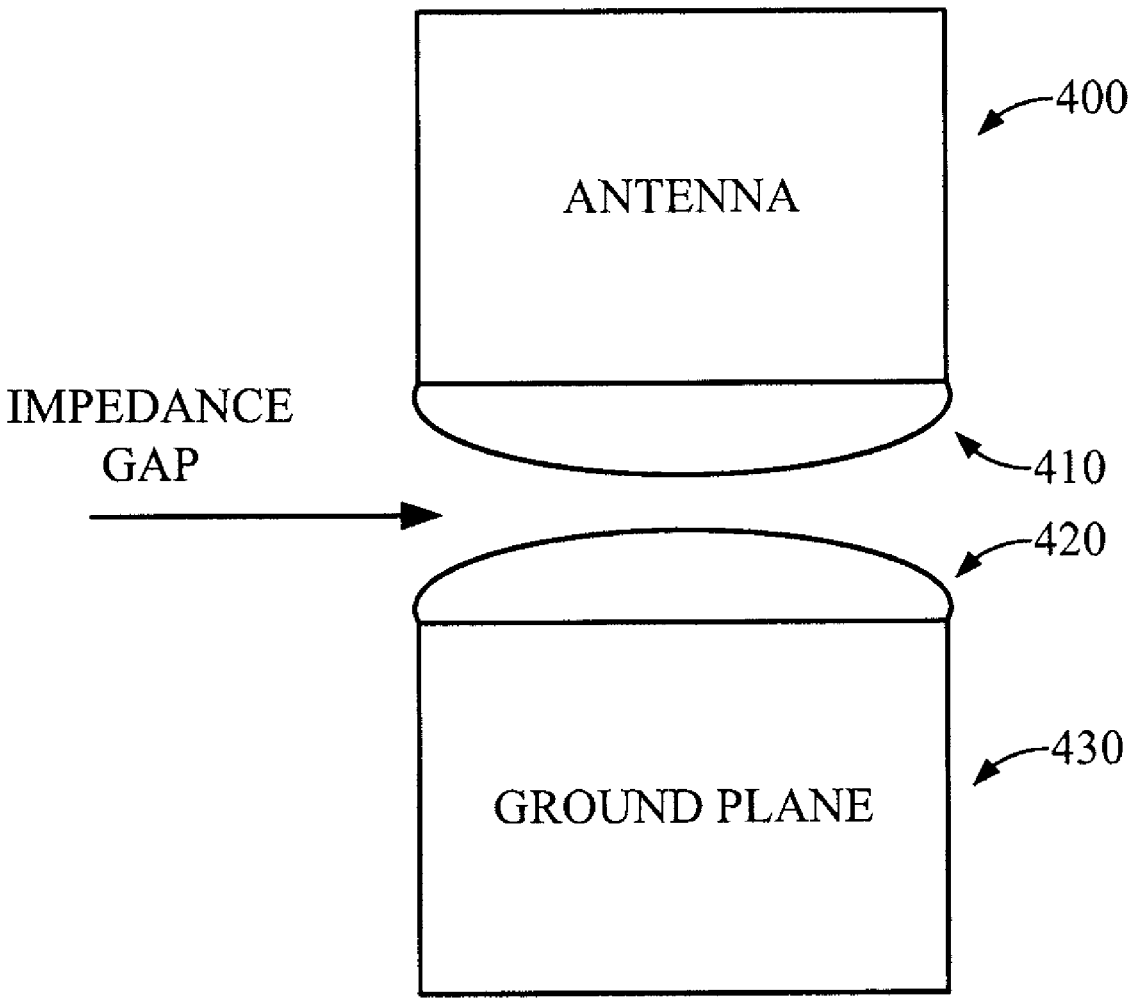
FIG. 4 illustrates an example ultra-wideband antenna and ground plane relationship.

FIG. 4 illustrates an antenna arrangement comprising a chip antenna 400 and a ground plane 430. A rectangular chip antenna 400 is illustrated having an elliptical component 410. Similarly, a ground plane 430 has an elliptical portion 420 corresponding to and opposing elliptical component 410. Designing opposing elliptical components 410 and 420 with an impedance gap between chip antenna 400 and ground plane 430 may result in a more uniform impedance over a substantially wider frequency range that includes Bluetooth as well as UWB band. In one aspect, the size and/or spacing of the elliptical components 410 and 420 can be implemented to maintain approximately 50 Ohm impedance. The impedance gap or the distance between chip antenna 400 and the ground plane 430 is a feed region which may be referred to as "delta gap." Typically, the smaller the delta gap, the more efficient operation is at higher frequency. In one example, the gap of about 0.5 mm may be implemented. However, it is to be appreciated that other characteristics can be provided by altering the shapes and/or spacing of elliptical components 410 and 420 respectively. For instance, the arc of the elliptical components 410 and/or 420 could be adjusted in an alternative embodiment to provide different impedance characteristics.

Figure 5A:
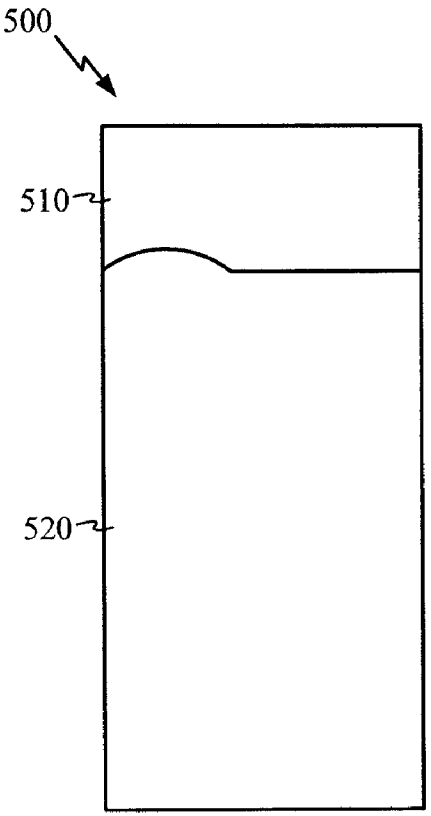
FIGS. 5A-C show an example mounting for an ultra-wideband chip antenna.
Figure 5B:
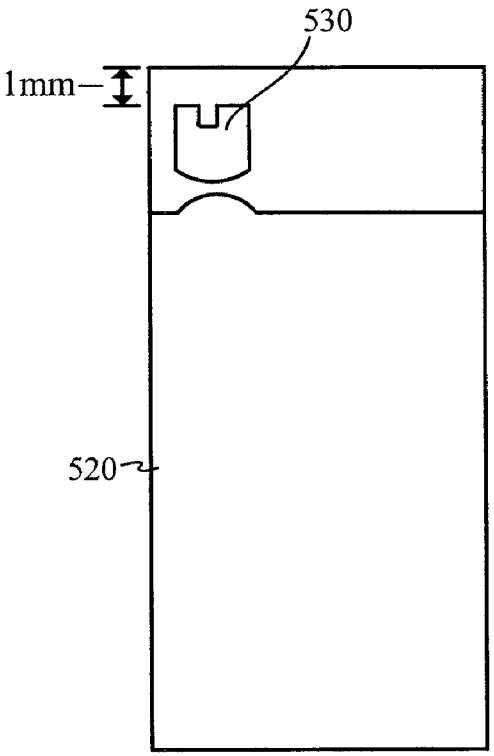
Figure 5C:
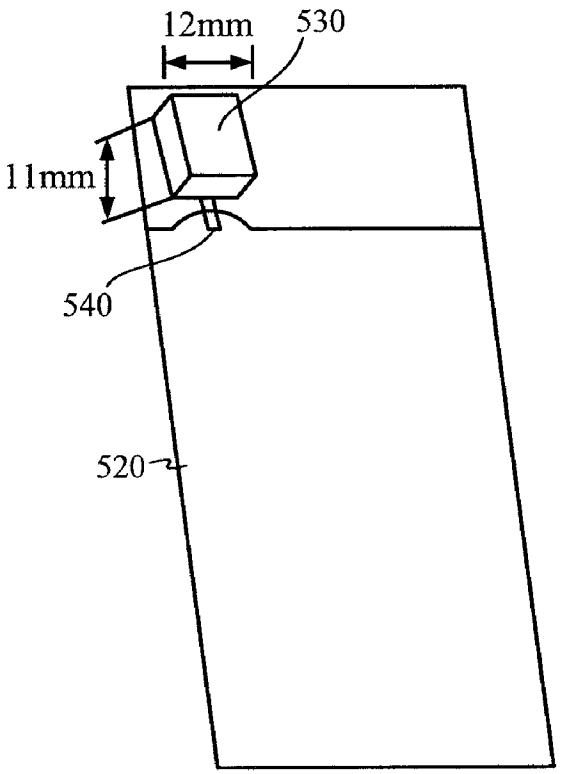

By implementing a chip antenna and ground plane of a selected shape, impedance gap and/or notching, the antenna parameters can be optimized for various frequency ranges, such as for example UWB and Bluetooth. FIGS. 5A-C illustrate example mounting for an ultra-wideband chip antenna. FIG. 5A shows a circuit board 500 including mounting point 510 and a ground plane 520. FIG. 5B shows a simplified internal design of a chip antenna 530 mounted on circuit board 500 at mounting point 510. Mounting point 510 may be offset from the top of circuit board 500 by a selected distance, such as for example 1 mm. In the example, chip antenna 530 has a rectangular shape with a slight elliptical spacing with respect to ground plane 520. Chip antenna 530 is also shown to include a rectangular notch. The notch may improve return loss performance of chip antenna 530. FIG. 5C shows the top of chip antenna 530 as mounted on circuit board 500 and a feed 540 coupling the chip antenna to circuit board 500. Feed 540 may be, for example, a coaxial feed or a micro strip feed.

Example dimensions for chip antenna 530 may be approximately 12 mm on one side and approximately 11 mm on the other side. Example dimension a ground plane may be approximately 40 mm by approximately 93 mm. An example substrate material for the chip antenna 530 could include a microwave substrate material (e.g., RO 6010, 100 mil thickness with dielectric constant of approximately 10.2, or other materials with a dielectric constant in the range of approximately 10-20). An example circuit board material could include an FR4, 32 mill specification but other styles may also be employed. It should be noted that the specific dimensions and material for chip antenna 530 are examples for operation from approximately 2.4 GHz to 8 GHz with a return loss of equal of better than 10 dB, and operational from approximately 8 GHz to the end of UWB range of approximately 10.6 GHz with a slightly degraded return loss. It would be apparent to those skilled in the art that the other sizes, shapes and materials may be used.

Generally, the horizontal dimension, 12 mm in the example, controls the bandwidth of chip antenna 530. The vertical dimension, 11 mm in the example, generally controls the lowest operation frequency of chip antenna 530. The size and/or shape of the ground plane also affect the lower operation frequency of chip antenna 530. The dielectric constant affects both the bandwidth and lower operation frequency of chip antenna 530. Moreover, the dimensions of antenna 530 are typically inversely proportional with the frequency. Namely, as the dimensions decrease, the operational bandwidth of antenna 530 shifts to higher frequencies.

Figure 6:
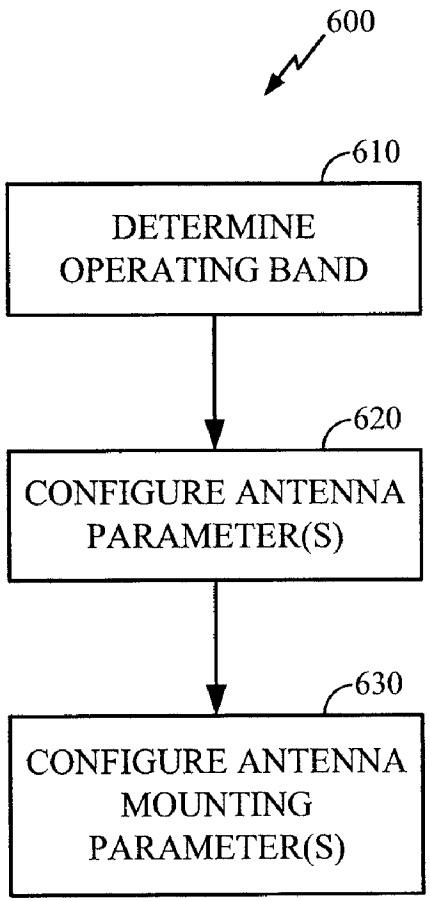
FIG. 6 shows an example process to implement an antenna operable in multiple frequency band.

FIG. 6 illustrates an example process 600 to design a diverse spectrum chip antenna. In process 600, antenna operating bands are determined 610. Here, it is desirable to have the antenna operate over more than one frequency band to allow more than one application for the antenna. In one example, an ultra-wideband is desirable along with a narrow band function such as Bluetooth that falls outside the UWB band. By designing for more than one application, antenna mounting real estate can be conserved along with mitigating antenna costs.

One or more antenna parameters for the determined operating bands may be configured 620 by various aspects. The aspects can include dielectric constant for the chip substrate, metallic characteristics for deposited antenna materials, printed circuit board characteristics, antenna shapes such as previously described, and/or whether to add one or more notches to the respective antenna along with the respective size, shapes, and locations for the notches. The notching, spacing and dielectric selections fine tunes chip antenna parameters. Also, one or more antenna mounting parameters may be configured 630 by determining the spacing between a chip antenna and a respective ground plane. Other consideration for setting the mounting parameters includes determining potential shapes between the antenna and the ground plane. As previously noted, opposite facing ellipses may be affixed to the antenna and ground plane to supply desired impedance characteristics for the antenna.

Figure 8:
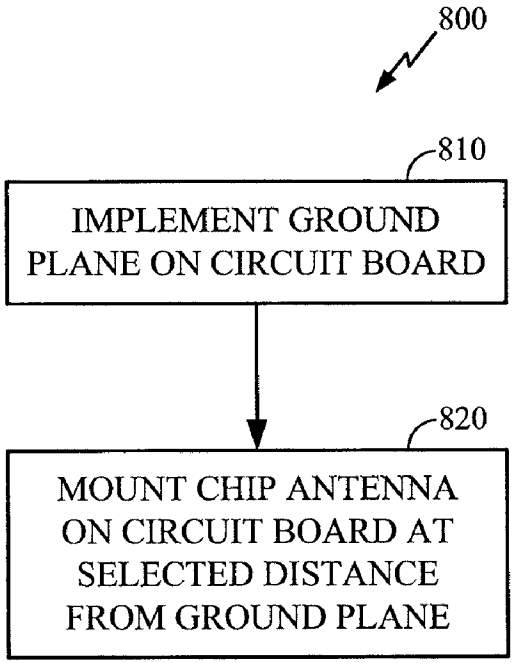
FIG. 8 shows an example method for implementing a diverse spectrum antenna.
Figure 7:
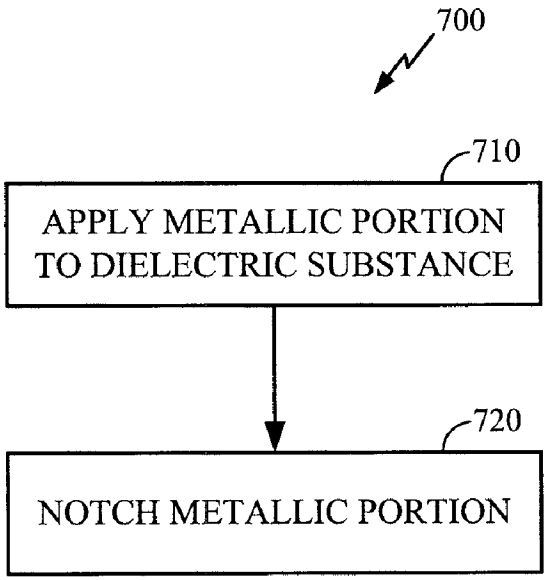
FIG. 7 shows an example method for producing a diverse spectrum antenna.

FIG. 7 illustrates an example method 700 to produce a diverse spectrum antenna as described above. In method 700, a chip antenna is generated 710 by applying a metallic portion to a dielectric substrate and notching 720 the metallic portion of the chip antenna. As discussed above, a ground plane may be coupled at a selected distance from the chip antenna. FIG. 8 illustrates an example method for implementing a diverse spectrum antenna on a device. In method 800, a ground plane is implemented 810 on a circuit board. Thereafter, a chip antenna can be mounted 820 on the circuit board at a selected distance from the ground plane. Here, the chip antenna includes a notch.

In methods 700 and 800, the chip antenna may be configured as designed according to process 600. For example, the chip antenna can be shaped as a rectangular shape with an elliptical component. Also, the ground plane may be shaped with an elliptical component corresponding to and opposing the elliptical component of the chip antenna. In addition, the notch may have a rectangular shape. The notch may be located at an upper edge of the chip antenna. An antenna arrangement can thus be optimized to operate over various frequency bands, including UWB and Bluetooth.

Accordingly, embodiments described provide for a more efficient, effective and/or simple antenna that operates across multiple frequency spectrums, including UWB frequency range and/or Bluetooth frequency range. By satisfying a plurality of spectrum requirements, cost and real estate can be reduced since additional antennas generally are needed to meet diverse spectrum performance requirements. Also, the relatively small size of the antenna arrangement may also reduce the cost and real estate of device implementing the antenna. Additionally, the antenna arrangement described above has a relatively low complexity, thereby making it relatively easy to implement and further reducing the cost of a device implementing the antenna.

Moreover, embodiments may be implemented by hardware, software, firmware, middleware, microcode, or any combination thereof. When implemented in software, firmware, middleware or microcode, the program code or code segments to perform the necessary tasks may be stored in a machine readable medium such as storage medium 140 or in a separate storage(s) not shown. A processor may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

It should be noted that the foregoing embodiments are merely examples and are not to be construed as limiting the invention. The description of the embodiments is intended to be illustrative, and not to limit the scope of the claims. As such, the present teachings can be readily applied to other types of apparatuses and many alternatives, modifications, and variations will be apparent to those skilled in the art.

What is claimed is:

1. A diverse spectrum antenna comprising:

a circuit board having a ground plane; and a substantially planar chip antenna including a notch, wherein the chip antenna is mounted on a surface of the circuit board at a selected distance from the ground plane, the chip antenna operable over a plurality of frequencies across at least two spectrums.

2. The antenna of claim 1, wherein the chip antenna is a rectangular shape with an elliptical component.

3. The antenna of claim 2, wherein the ground plane has an elliptical component corresponding to and opposing the elliptical component of the chip antenna.

4. The antenna of claim 1, wherein the notch is a rectangular shape.

5. The antenna of claim 1, wherein the notch is located at an upper edge of the chip antenna.

6. The antenna of claim 1, wherein the chip antenna may comprise a metal portion attached to a dielectric substrate.

7. A method for producing a diverse spectrum antenna, the method comprising:

applying a major surface of a substantially planar metallic portion to a major surface of a substantially planar dielectric substrate to generate a chip antenna; and notching the metallic portion of the chip antenna, the chip antenna operable over a plurality of frequencies across at least two spectrums.

8. The method of claim 7, further comprising:

coupling a ground plane at a selected distance from the chip antenna.

9. The method of claim 7, further comprising:

shaping the chip antenna as a rectangular shape with an elliptical component.

10. The method of claim 9, further comprising:

coupling a ground plane at a selected distance from the chip antenna, wherein the ground plane has an elliptical component corresponding to and opposing the elliptical component of the chip antenna.

11. The method of claim 7, wherein the notching comprising:

notching a notch of rectangular shape.

12. The method of claim 7, wherein the notching comprising:

notching an upper edge of the chip antenna.

13. An antenna produced by a process as in the method of claim 7.

14. Apparatus for use in communication comprising:

a communication module configured to support communication functions; and an antenna module configured to transmit and receive communication signals, wherein the antenna module comprises:

a substantially planar chip antenna having a notch, wherein the chip antenna is mounted substantially in-plane on a surface of a dielectric substrate; and a ground plane operatively coupled to the chip antenna, the chip antenna operable over a plurality of frequencies across at least two spectrums.

15. The apparatus of claim 14, wherein the chip antenna is a rectangular shape with an elliptical component.

16. The apparatus of claim 15, wherein the ground plane has an elliptical component corresponding to and opposing the elliptical component of the chip antenna.

17. The apparatus of claim 14, wherein the notch is a rectangular shape.

18. The apparatus of claim 14, wherein the notch is located at an upper edge of the chip antenna.

19. The apparatus of claim 14, wherein the chip antenna comprises a metal portion attached to the dielectric substrate.

20. A method for implementing a diverse spectrum antenna, the method comprising:

implementing a ground plane on a circuit board; and mounting a substantially planar chip antenna on a surface of the circuit board at a selected distance from the ground plane, wherein the chip antenna includes a notch, the chip antenna operable over a plurality of frequencies across at least two spectrums.

21. The method of claim 20, further comprising:

shaping the chip antenna as a rectangular shape with an elliptical component.

22. The method of claim 21, further comprising:

shaping the ground plane with an elliptical component corresponding to and opposing the elliptical component of the chip antenna.

23. The method of claim 20, wherein the notch has a rectangular shape.

24. The method of claim 20, wherein the notch is located at an upper edge of the chip antenna.

25. The method of claim 20, wherein the chip antenna may comprise a metal portion attached to a dielectric substrate.

26. A diverse spectrum antenna comprising:

means for applying a major surface of a substantially planar metallic portion to a major surface of a substantially planar dielectric substrate to generate a chip antenna; and means for notching the metallic portion of the chip antenna, the chip antenna operable over a plurality of frequencies across at least two spectrums.

27. A diverse spectrum antenna comprising:

means for implementing a ground plane on a circuit board; and means for mounting a substantially planar chip antenna on a surface of the circuit board at a selected distance from the ground plane, wherein the chip antenna includes a notch, the chip antenna operable over a plurality of frequencies across at least two spectrums.

* * * * *